US007946828B2

(12) United States Patent
Ovsthus et al.

(10) Patent No.: US 7,946,828 B2
(45) Date of Patent: May 24, 2011

(54) SCREW TYPE LIQUID RING PUMP WITH SHAFT SEAL ARRANGEMENT

(75) Inventors: Eimund Ovsthus, Lonevaag (NO); Aksel Ovsthus, Lonevaag (NO)

(73) Assignee: Jets A/S, Hareid (NO)

( * ) Notice: Subject to any disclaimer, the term of this patent is extended or adjusted under 35 U.S.C. 154(b) by 997 days.

(21) Appl. No.: 10/555,782

(22) PCT Filed: May 5, 2004

(86) PCT No.: PCT/NO2004/000131
§ 371 (c)(1),
(2), (4) Date: Nov. 28, 2006

(87) PCT Pub. No.: WO2004/099619
PCT Pub. Date: Nov. 18, 2004

(65) Prior Publication Data

US 2007/0172366 A1 Jul. 26, 2007

(30) Foreign Application Priority Data

May 7, 2003 (NO) ..... 20032052

(51) Int. Cl.
*F04C 19/00* (2006.01)
*F16J 15/00* (2006.01)

(52) U.S. Cl. ..... 417/68; 277/379; 277/385; 277/392

(58) Field of Classification Search ..... 417/68, 417/69; 241/46.02; 415/231, 109, 168.3, 415/230; 277/377, 379, 385, 390, 391, 392; 416/174
See application file for complete search history.

(56) References Cited

U.S. PATENT DOCUMENTS 1,998,611 A * 4/1935 Ford ..... 415/174.3
2,230,510 A * 2/1941 Lignian et al. ..... 68/133
(Continued)

FOREIGN PATENT DOCUMENTS

DE 2731451 B * 4/1978
(Continued)

OTHER PUBLICATIONS

Machine Translation of DE2731451B.*

*Primary Examiner* — Devon C Kramer
*Assistant Examiner* — Nathan Zollinger
(74) *Attorney, Agent, or Firm* — Roberts Mlotkowski Safran & Cole, P.C.; David S. Safran

(57) ABSTRACT

Screw type liquid ring pump including a pump housing (9) with an inlet part (3) and an outlet part (11) and rotating helical screw rotor (8) inside the housing. The rotor is connected with a shaft (7) as well as a driving unit in the form of motor, preferably an electric motor (2), whereby the pump (20) with the pump housing (9) represents an elongation of the motor (2) with the motor housing thus representing an integrated or one piece unit. The shaft seal (22, 23) is provided wholly or partially in an annular space (24) provided within the rotor (8), whereby one end of the seal rests against an annular part (25) of the screw rotor provided in the annular space (24) between the rotor and the shaft, and its other end is tightly engaged against an inwardly protruding part (21) at the outlet end of the pump.

5 Claims, 2 Drawing Sheets

U.S. PATENT DOCUMENTS

| | | | | | |
|---|---|---|---|---|---|
| 2,527,238 | A | * | 10/1950 | Woodson | 192/3.61 |
| 2,610,871 | A | * | 9/1952 | Woodson | 277/392 |
| 2,692,787 | A | * | 10/1954 | Brummer | 277/392 |
| 2,761,393 | A | * | 9/1956 | Di Stefano et al. | 96/214 |
| 2,842,063 | A | * | 7/1958 | Kishline et al. | 415/182.1 |
| 2,975,714 | A | * | 3/1961 | Nechine | 241/46.02 |
| 3,221,659 | A | * | 12/1965 | Adams | 417/69 |
| 3,602,604 | A | * | 8/1971 | Ronellenfitch | 415/72 |
| 3,966,363 | A | * | 6/1976 | Rowley et al. | 417/423.11 |
| 4,443,158 | A | | 4/1984 | Bentele et al. | |
| 5,305,586 | A | * | 4/1994 | Lundahl et al. | 56/14.4 |
| 5,344,085 | A | * | 9/1994 | Hofseth | 241/46.02 |
| 5,507,625 | A | * | 4/1996 | Dudeck | 417/68 |
| 5,768,868 | A | * | 6/1998 | Stein | 56/14.5 |
| 6,390,666 | B1 | * | 5/2002 | Schafer et al. | 366/331 |
| 7,029,231 | B2 | * | 4/2006 | Hofseth | 415/72 |
| 7,108,418 | B2 | * | 9/2006 | Crall et al. | 366/64 |
| 7,562,879 | B1 | * | 7/2009 | Blakeslee et al. | 277/590 |
| 7,673,479 | B2 | * | 3/2010 | Dahlheimer | 68/5 E |

FOREIGN PATENT DOCUMENTS

| | | | | |
|---|---|---|---|---|
| JP | 56014887 | A | * | 2/1981 |
| JP | 06081788 | A | * | 3/1994 |
| RU | 2135835 | C1 | * | 8/1999 |
| WO | WO 02097275 | A1 | * | 12/2002 |

* cited by examiner

SCREW TYPE LIQUID RING PUMP WITH SHAFT SEAL ARRANGEMENT

BACKGROUND OF THE INVENTION

1. Field of Invention

The present invention relates to a screw type liquid ring pump including a pump housing with an inlet and an outlet and a rotating helical screw rotor inside the housing, the rotor being connected with a shaft and a driving unit in the form of a motor, preferably an electric motor, whereby the pump housing represents an elongation of the motor housing forms an integrated or one-piece unit therewith.

2. Description of Related Art

Liquid ring pumps of the above kind are commonly known where the pump and the driving unit, usually an electric motor, are built together forming a unit. With such a solution, the production is simplified and the costs are reduced, mainly due to the fact that fewer constructional parts are required, such as only one shaft and two shaft bearings, compared to a conventional solution where the pump and rotor are manufactured as two independent units, each with two bearings. The structural length of the pump is much shorter with the one piece solution, whereby the pump requires less space and is more effective relative to the size of the pump.

In commonly-owned European patent No. 0 454 794, an example is shown of a conventional liquid ring type helical screw pump with a motor, each with its own shaft and own bearings, as well as an integrated solution where a common shaft is used for the pump and motor. With this last mentioned pump solution with a common shaft, the shaft seal between the pump and motor is provided, in relation to the motor housing, in front of the housing. A disadvantage with this solution is that leakage in the shaft seal will result in moisture entering into the bearing and further into the motor housing which, in the worst case, will result in break down of the motor. Another disadvantage is that the seal arrangement as such and the connection between the pump and the motor is relatively complicated and causes additional work in connection with the mounting and maintenance of the pump.

SUMMARY OF THE INVENTION

The present invention provides an improved shaft seal solution which eliminates or at least essentially reduces the problem of leakage to the motor, which is essentially simpler to assemble and which provides essentially a shorter construction length of the total pump and motor solution.

The invention is characterized in that the shaft seal is provided wholly or partially in an annular space in the rotor, whereby one end of the seal is resting against an annular part of the screw rotor provided in the annular space between the rotor an the shaft, and at its other end is tightly provided against an inwardly protruding party at the outlet end of the pump.

The invention will be further described in the following with reference to the accompanying drawings.

DETAILED DESCRIPTION OF THE INVENTION

Figure 1:
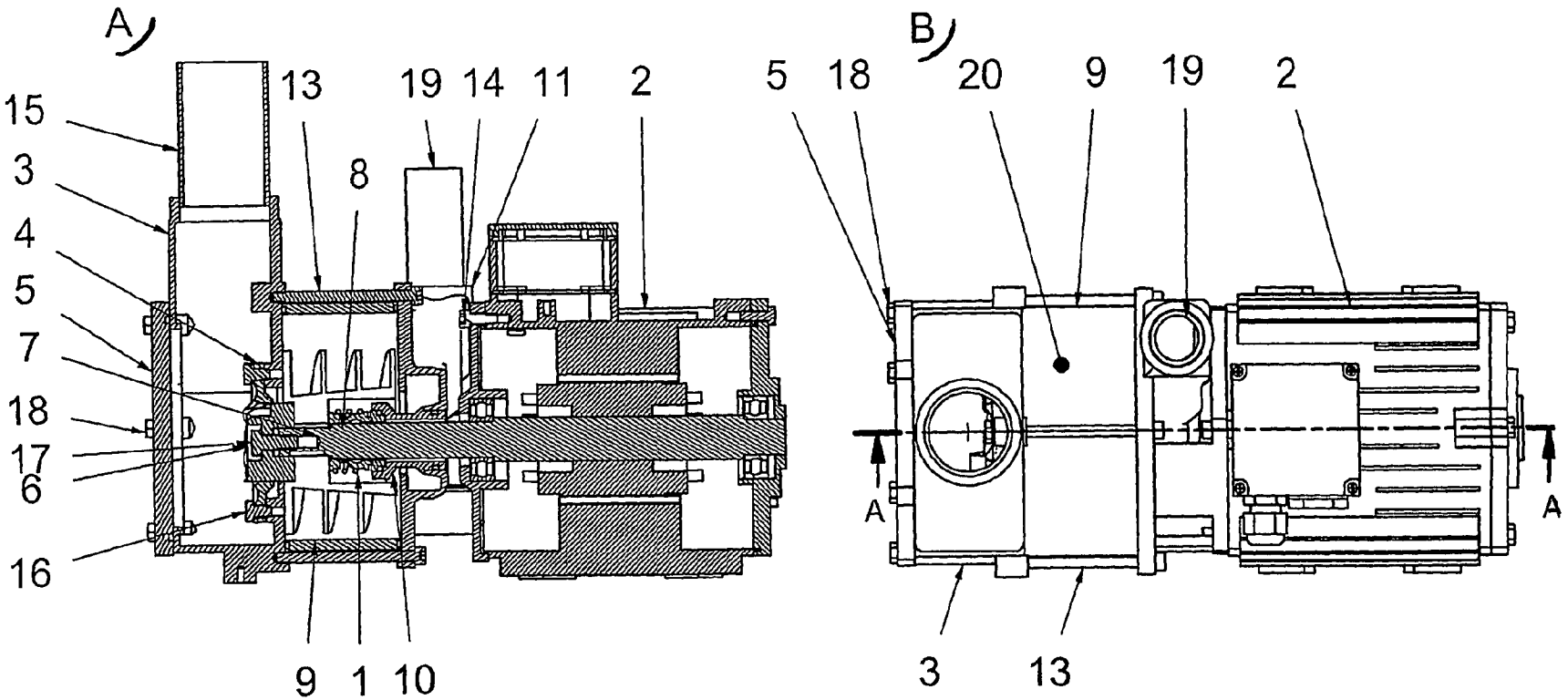
FIGS. 1A & 1B show a screw type liquid ring pump according to the invention in vertical cross section and from above, respectively.

FIG. 1 shows, as mentioned above, a pump and motor solution according to the invention. It includes a driving unit in the form of a motor, preferably an electric motor 2 and a pump unit 20 in the form of a liquid ring screw pump (with a helical screw rotor 8) built together as an integrated unit. The pump unit, as such, also includes an inlet part 3 with an inlet connection 15, a screw rotor 8 connected at its forward part with a shaft 7 as is common for a motor and pump, a rotor housing 9 and an outlet part or pressure chamber part 11 with an outlet part connection 19. The outlet part is an intermediate piece between the pump 20 and the motor 2 and forms the connection between the two units, whereby the outlet part 19 is connected with the housing for the motor 2 via a screw connection by means of screws 14.

The main parts of the pump unit 20, i.e., the inlet part 3, the rotor housing 9 and the outlet part 11 are, on the other hand, with an intermediate seal element (not shown) held together in a tight connection by means of suitable screws 13.

The pump 20 further includes, in the example shown in the drawings, a grinder 4 with a cutter provided at the outer end of the motor and pump shaft 7 in the inlet part 3 which thus, in the present case, is in the form of a grinder housing suitably adapted to the grinder 4. The inlet part or grinder housing 3 is further provided with, by means of screws 18, a removable end plate 5 which provides easy access to the space within the grinder housing to enable cleaning of the grinder and the area therein. The cutter elements of the grinder 4 are replaceable by means of screws 16, 17.

Figure 2:
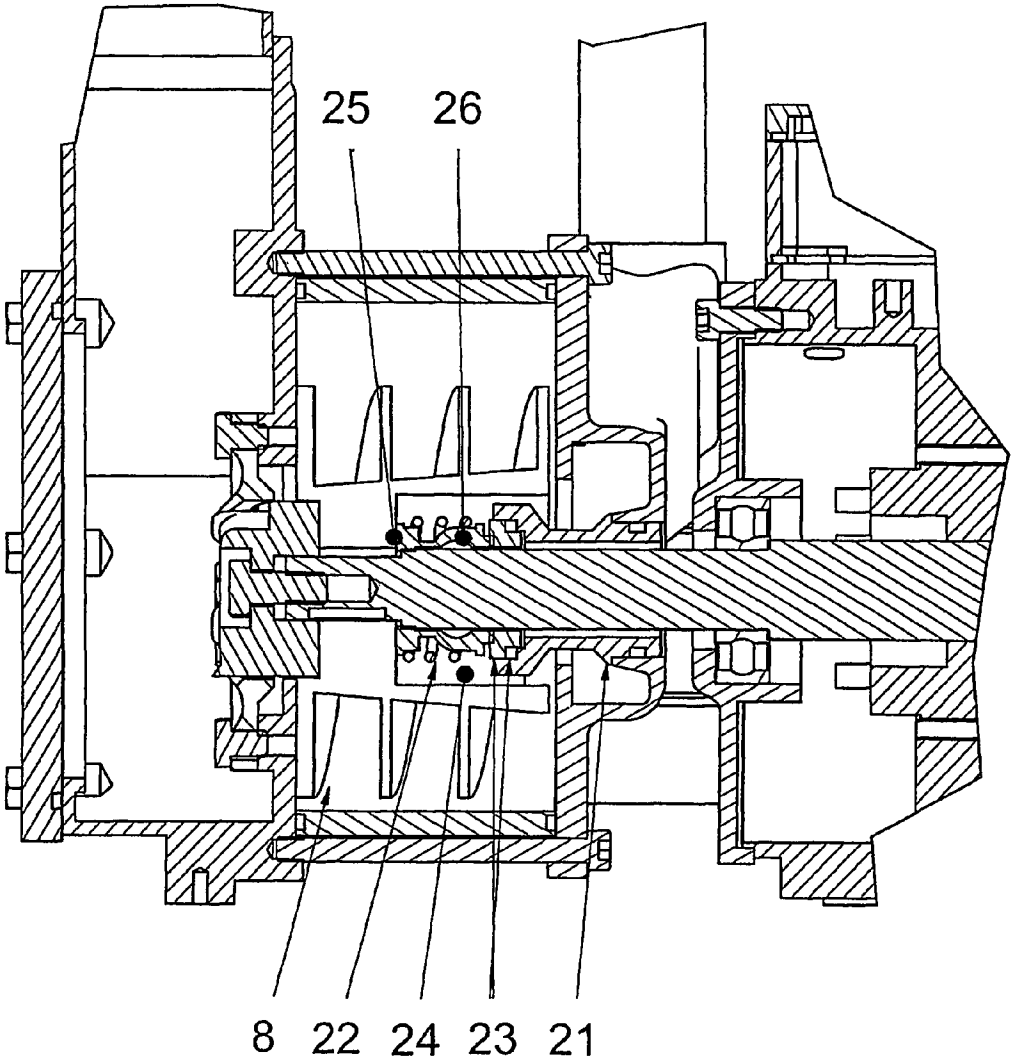
FIG. 2 is an enlarged cross-sectional view of a part of the pump shown in FIG. 1A, in the area around the rotor and the shaft seal.

The uniqueness of the invention, which is further shown in FIG. 2, is related to the design and provision of the shaft seal 22, 23 being arranged in an annulus 24 which is formed, by machining by suitable means, in the rotor 8, between the rotor and the shaft 7, whereby the seal at its inner end, by means of spring 1 of a spring activated (mechanical) seal element 22 is forced against an annular part 25 in the annulus 24 via a rotatable wear and seal ring 23, and at its other end via a stationary wear and seal ring 26, and is kept tightly resting against an inwardly protruding part 10 that is connected to the outlet part 11. In the here shown example in FIG. 2, the inwardly protruding part, due to mounting and production reasons, is formed by a bushing 21 which is connected to the outlet part 11. With this solution, a larger intermediate space is formed between the outlet part 11 (the bushing 21) and the motor housing such that moisture or fluid, if there is a leakage through the seal 22, 23, 25, 26, may easily be drained out of the pump. The constructional length of the pump is further reduced since the seal is provided in the annulus of the rotor. Basically, the reduction of the constructional length of the motor and pump unit equals the length of the annulus 24 of the rotor in which the seal is provided. The fact that the seal is provided within the rotor also results in that the rotor is not exposed to the liquid or gas that is flowing through the pump which reduces or eliminates corrosion of the rotor. This, in turn, implies that the rotor may be manufactured of a cheaper material, for instance black iron, which is cheaper than the material of which the other parts and components of the pump is made from. A still further advantage with the present invention is that the pump is made of fewer components which, in turn, makes it simpler and cheaper to produce.

It should be noted, even though the example shown in the drawings and described above includes a grinder, that the invention as defined is not limited to a pump with a grinder, but may as well be used for a pump without a grinder.

The invention claimed is:

1. Screw type liquid ring pump, comprising:

a driving unit having a motor with a motor housing, a pump housing with an inlet part and an outlet part, the pump housing being axially aligned with the motor housing and forming an integrated unit therewith, a rotating helical screw rotor inside the pump housing, the rotor being connected with a shaft of the driving unit, and a shaft seal for the shaft, wherein the shaft seal is completely arranged in an annular space provided within the rotor, a first end of the shaft seal resting against an annular part of the rotor in the annular space between the rotor and the shaft, and a second end of the shaft seal tightly engaging against an inwardly protruding part which protrudes from an outlet end of the pump into said annular space.

2. Screw pump according to claim 1, wherein the shaft seal comprises a spring actuated seal element having a rotatable wear and seal ring for sealing against the annular part of the rotor and a stationary wear and seal ring for sealing tightly against the inwardly protruding part at the outlet end of the pump.

3. Screw pump according to claim 2, wherein the inwardly protruding part is a bushing which is releasably attached to the outlet end of the pump.

4. Screw pump according to claim 1, wherein the inwardly protruding part is a bushing which is releasably attached to the outlet end of the pump.

5. Screw pump according to claim 4, wherein the outlet end of the pump is a separate part which is attached at one end to the motor and which forms a pressure chamber of the pump at an opposite end which is releasably attached to the pump housing.

* * * * *